United States Patent [19]

Branecky et al.

[11] 4,395,255

[45] Jul. 26, 1983

[54] WEB FOLDING APPARATUS

[75] Inventors: George N. Branecky, Bethel; Frank T. Roetter, Westport; Frank A. Oeschger, East Norwalk, all of Conn.

[73] Assignee: Pitney Bowes Inc., Stamford, Conn.

[21] Appl. No.: 311,719

[22] Filed: Oct. 15, 1981

Related U.S. Application Data

[63] Continuation-in-part of Ser. No. 188,174, Sep. 17, 1980, Pat. No. 4,378,223.

[51] Int. Cl.[3] ..... B65H 45/22

[52] U.S. Cl. ..... 493/439; 493/446

[58] Field of Search ..... 493/438–440, 493/442, 454, 446–448, 459, 461, 462

[56] References Cited

U.S. PATENT DOCUMENTS

| | | | |
|---|---|---|---|
| 695,301 | 3/1902 | Gay | 493/439 X |
| 2,619,057 | 11/1952 | Ellis | 493/439 X |
| 2,879,061 | 3/1959 | Alden | 226/195 |
| 3,356,557 | 12/1967 | Enskat | 493/439 X |
| 4,050,361 | 9/1977 | Traise | 226/195 |
| 4,285,686 | 8/1981 | Ambler | 493/439 |

FOREIGN PATENT DOCUMENTS

| | | | |
|---|---|---|---|
| 77236 | 3/1918 | Switzerland | 493/439 |

*Primary Examiner*—A. J. Heinz

*Attorney, Agent, or Firm*—Donald P. Walker; William D. Soltow, Jr.; Albert W. Scribner

[57] ABSTRACT

For use in combination with a machine for feeding a web of paper in a downstream path of travel, there is provided apparatus for folding an unfolded web of paper along its longitudinally-extending weakened fold line. The apparatus comprises: a frame; web drag structure including a drag member which longitudinally extends across the path of travel of the unfolded web for frictional engagement by the web; a lower roller which is rotatably attached to the frame below the level of the drag member so as to extend transverse to the drag member and at an angle of approximately 95° with respect to a vertical plane passing through the drag member, such that an unfolded web may extend downwardly in its path of travel from the drag member, into engagement with the lower roller and be gradually folded between them; and an output roller which is rotatably attached to the frame below the level of the drag member so as to extend transverse to the drag member and such that the folded web may extend from beneath the lower roller and into engagement with the output roller and the from beneath the output roller to the machine. In addition, the apparatus comprises web guiding structure including a pair of drag elements connected to the frame as to extend into engagement with the web between the drag member and lower roller, the drag elements being constructed and arranged for engaging the partially folded web on opposite sides of the fold line for pre-creasing the web along the fold line.

8 Claims, 6 Drawing Figures

4
28
4
6
68
64
48
66
58

5
102
94
90
5
38
98
76
76
70
88
12
85
95°±1°
86
72
32
34
6

WEB FOLDING APPARATUS

BACKGROUND OF THE INVENTION

This Application is a continuation-in-part of our U.S. Application Ser. No. 188,174, filed Sept. 17, 1980 now U.S. Pat. No. 4,378,223 for Web Folding Apparatus.

In the forms folding apparatus disclosed in U.S. Pat. No. 3,356,557 issued Dec. 5, 1967 to A. G. Enskat, a web of paper is fed from a first roller to a second roller which is oriented at right angles to the first roller and spaced above the same. And, the web is folded in the course of traveling upwardly between the rollers although no controlling structure is provided to assist in the folding operation. In practice, it has been found that the lack of provision of such controlling structure militates against usage of the apparatus for folding webs of different widths and/or weights per unit length, for example, under different environmental conditions, or for folding webs which include a weakened fold line which is not centrally located along the longitudinal length of the web. In addition, it has been found that even when some forms of web folding control structure are added to such apparatus, one or more of the aforesaid problems persist. On the other hand, it has been found that the aforesaid problems are to some extent alleviated when the aforesaid structure is modified such that rather than folding the web as it is being raised, from a lower roller to an upper roller, the web is folded as it is being lowered, provided the upper roller is converted to a drag member, and more particularly, to adjustable drag means. In addition, it has been found that when such modified structure is further improved to include fold pre-creasing structure between the upper drag means and lower roller, and the lower roller disposed at an angle of approximately 95° with respect to a vertical plane extending through the drag member, the aforesaid problems are substantially eliminated. With the above thoughts in mind and with a view to additionally providing for guidance of the folded web as it exits the folding apparatus:

An object of the present invention is to provide web folding apparatus for use with a machine for feeding a folded web of paper;

Another object is to provide, for use with a web feeding machine, improved apparatus for folding an unfolded web along with a longitudinally-extending weakened fold line; and Yet another object is to provide the aforesaid improved web folding apparatus with means for pre-creasing and then creasing the fold edge of a gradually folded web as it progresses in a downstream path of travel.

SUMMARY OF THE INVENTION

For use in combination with a machine for feeding a web of paper in a downstream path of travel, there is provided apparatus for folding an unfolded web of paper along a longitudinally-extending weakened fold line thereof, said apparatus comprising: a frame; web drag means including a drag member longitudinally extending across the path of travel of an unfolded web for frictional engagement thereby; a lower roller, rotatably attached to the frame below the level of the drag member so as to extend transverse to the drag member and at an angle of approximately 95° with respect to a vertical plane extending through the drag member, such that an unfolded web may extend downwardly from said drag member and into engagement with said lower roller and be gradually folded therebetween, an output roller rotatably attached to the frame below the level of the drag member so as to extend transverse to the drag member and such that said folded web may extend from beneath said lower roller to said output roller and into engagement therewith; and web guide means including a pair of drag elements connected to the frame as to extend into engagement with the web between the drag member and lower roller such that said elements engage the partially folded web on opposite sides of the fold line for pre-creasing the web along the fold line.

BRIEF DESCRIPTION OF THE DRAWINGS

As shown in the drawings wherein like reference numerals designate like or corresponding parts throughout the several figures.

DESCRIPTION OF THE PREFERRED EMBODIMENT

Figure 1:
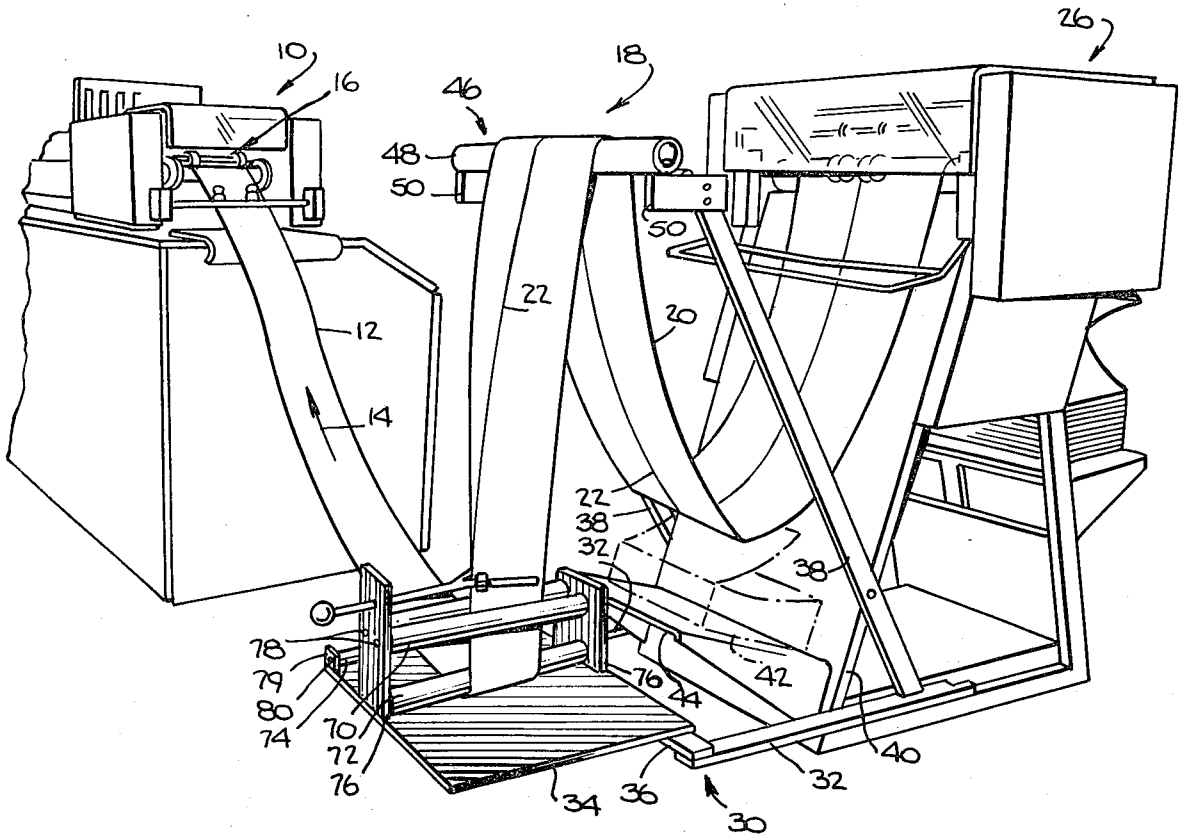
FIG. 1 is a perspective view of the web folding apparatus according to the invention, shown in combination with a conventional machine for feeding a web through the apparatus.

As shown in FIG. 1, a business machine 10 of the type which performs work operations on a folded web 12 of paper, as the web is fed in a downstream path of travel 14, may comprise a burster-folder. And, such machines 10 generally include conventional means 16 for intermittently feeding the folded web 12 in the downstream path of travel 14. According to the invention there is provided, for use with the such machines 10, apparatus 18 for folding an unfolded web 20 of paper, such as a computer form, along its longitudinally-extending weakened fold line 22. In practice, the weakened fold line 22 is preferably a score line formed in the web 20 by a conventional forms conveyor 26 having well-known structure 28 (FIG. 2) such as a conventional scoring device for forming an uninterrupted, weakened, fold line 22 (FIG. 1).

Figure 2:
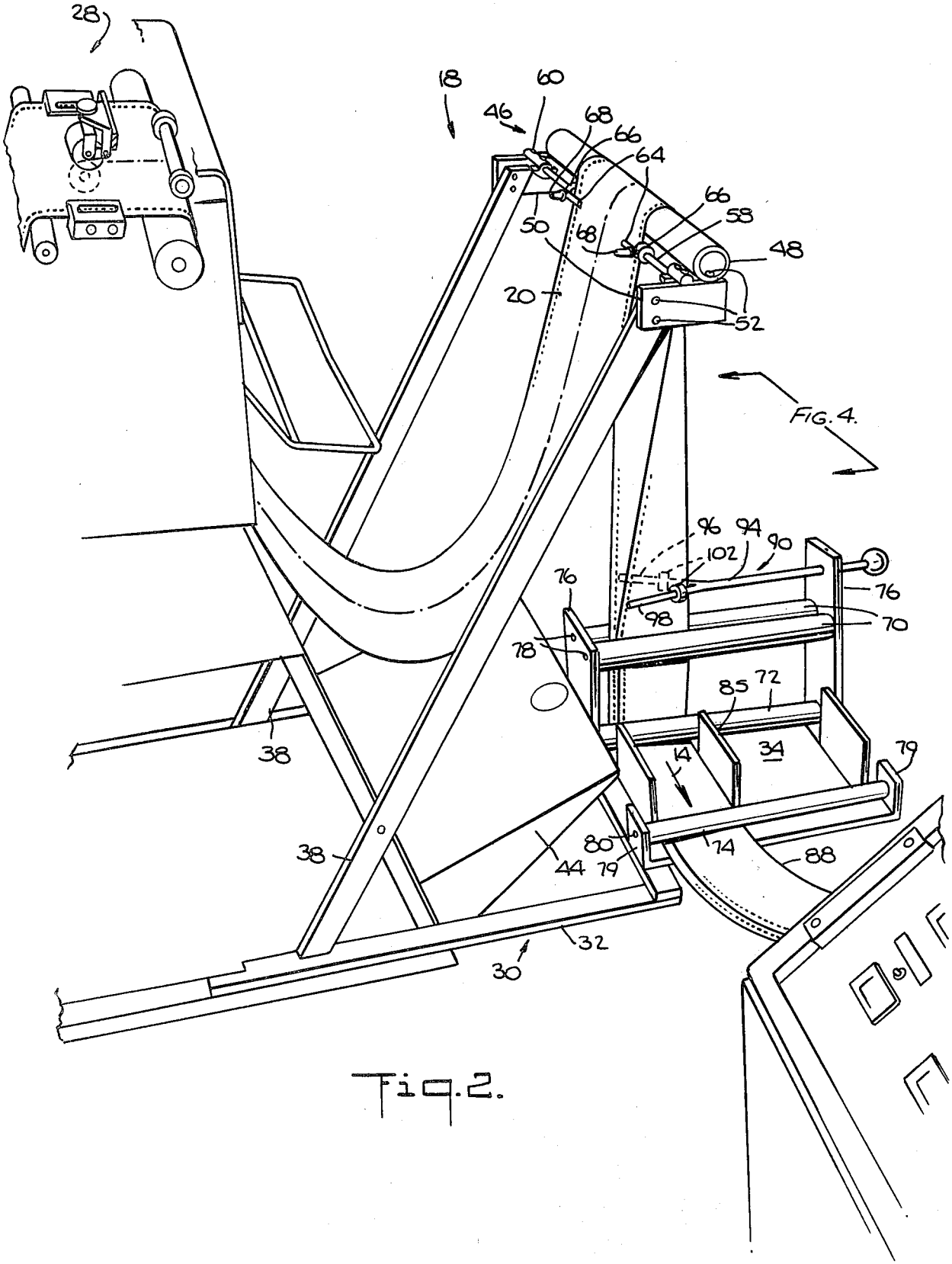
FIG. 2 is an enlarged, fragmentary, side perspective view of the web folding apparatus of FIG. 1, showing the downstream path of travel in which the web is fed through the web drag means and web guide means of the apparatus.

The folding apparatus 18 (FIG. 1) comprises a suitable frame 30 for supporting the various web handling components of the apparatus 18. To that end, the frame 30 includes a pair of parallel-spaced base legs 32, and includes a base plate 34 which is fixedly attached to the base legs 32 as by means of a base strut 36. In addition, the frame 30 includes a pair of parallel-spaced upright struts 38, having their lower ends conventionally fixedly attached to the base legs 32 on a one-for-one basis. To facilitate associating the apparatus 18 with a scoring device 28 (FIG. 2) the frame 30 (FIG. 1) may additionally include an upright web guide wall 40, which is conventionally fixedly attached to the frame's base legs 32 and to the frame's upright struts 38 so as to extend high enough upwardly to afford for guidance of the unfolded web 20 as it is fed from the scoring device 28 (FIG. 2). On the other hand, the folding apparatus 18 (FIG. 1) may also be used for folding an unfolded web 20 as it is fed from a fan-folded stack 42, without associating the apparatus 18 with a scoring device 28 (FIG. 2), it being assumed that the web 20 (FIG. 1) in the stack 42 has already been provided with a scored fold line 22. To that end, the frame 30 may, in lieu of the higher guide wall 40, include a shorter upright guide wall 40, which preferably extends upwardly from the base legs 30 a sufficient distance to be affixed to the upright struts 38 for structural rigidity. And, for supporting the fan-folded stack 42, the frame 30 would then additionally include a conventional plate 44 which is suitably fixedly attached to the struts 38 so as to provide a platform on which the fan-folded web stack 42 may be loaded for feeding therefrom by the machine 10.

For web handling purposes the folding apparatus 18 (FIG. 1) is provided with web drag means 46, including an elongated drag member 48 which is conventionally fixedly attached to the frame 30, as by means of a pair of parallel-spaced arms 50 which are suitably fixedly attached to both the frame's upright struts 38 and to the opposite ends of the member 48, as by means of plurality of fasteners 52 (FIG. 2). The drag member 48 (FIG. 1) is preferably an elongated member having an upper, curvedly-extending exterior surface, such as the tube which is shown. The drag member 48 extends across the path of travel of the unfolded web 20 for frictional engagement thereby. To adjust the extent of frictional engagement of the unfolded web 20 with the web drag member 48, the drag means 46 (FIG. 2) additionally includes an elongated guide bar 58. The guide bar 58 is conventionally fixedly attached to the frame 30, as by means of fasteners 60 which attach the opposite ends of the bar 58 to the arms 50, so that the bar 58 longitudinally extends parallel to the drag member 48 and upstream thereof in the path of travel of the unfolded web 20. In addition, for adjusting the extent of frictional engagement of the unfolded web 20 with the drag member 48, the web drag means 46 includes a pair of finger members 64. The finger members 64 are spaced apart from each other and conventionally adjustably fixedly attached to the guide bar 58, for positioning the fingers 64 in engagement with the outer surface of the unfolded web 20. To that end, each of the fingers 64 is fixedly attached to a collar 66 which is, in turn, conventionally adjustably rotatably attached, as by means of a thumb screw 68, to the guide bar 58. The collars 66 are slidably movable along the length of the guide bar 58, and thus toward and away from the opposed longitudinally extending edges of the unfolded web 20. Accordingly, if it is desirable to eliminate the extent of frictional engagement between the unfolded web 20 and drag member 48, the finger members 64 may be rotated for moving the finger members 64 out of engagement with the web 20; in which instance the collars 66 provide for guidance of the web 20 in its path of travel toward the drag member 48, but do not exert a frictional drag force on the unfolded web 20. On the other hand, for incrementally increasing the extent of frictional engagement between the web 20 and drag member 48, and between the web 20 and guide bar 58, and between the web 20 and finger members 64, the finger members 64 may be rotated to a greater or lesser extent into engagement with the unfolded web 20.

For web guiding purposes, the folding apparatus 18 (FIG. 2) additionally includes at least one and preferably two upper rollers 70, a lower roller 72 and an output roller 74. The upper rollers 70 are spaced below the drag member 48. For assisting in the web folding process, the rollers 70 are horizontally parallel-spaced from each other and respectively conventionally rotatably attached to the frame 30, as by means of a suitable pair of parallel-spaced upright brackets 76 which are affixed to the frame's base plate 34 and a suitable number of pivot pins 78 supported by the brackets 76. The respective rollers, 70 and 72, longitudinally extend across the path of travel of the folded web 12; the upper rollers 70 extending at right angles with respect to the longitudinal length of the drag member 48, and the lower roller 72 extending in the same direction as, but non-parallel with respect to, the upper roller 70. In practice it has been found that when the lower roller 72, is mounted such that it longitudinally extends at an angle of ninety-five degrees, plus or minus one degree, with respect to a vertical plane extending through the axis of the drag member 48, the web 20 is properly creased as the machine 10 urges it into engagement with the lower roller 72. Preferably the aforesaid angle is 95 degrees. The output roller 74 is spaced parallel with respect to the upper rollers 70 and conventionally fixedly attached to the frame 30, as by means of an additional pair of parallel-spaced upright brackets 79, which are suitably affixed to the frame's base plate 34, and an additional pivot pin 80.

The unfolded web 20 extends from the fold line scoring device 28 (FIG. 2) or upwardly from web stack 42 (FIG. 1), as the case may be, into engagement with the drag member 48 and over the upper, curvedly-extending surface of the drag member 48. The web 20 (FIG. 2) then extends downwardly from the drag member 48 to the lower roller 72. Before engaging the lower roller 72 the unfolded web is gradually folded along its longitudinally-extending weakened fold line 22. The folded web 12 is then looped about lower roller 72 so as to extend downstream in its path of travel from beneath the lower roller 72 to the output roller 74. And, as best shown in FIG. 2, the folded web 12 is then looped beneath the output roller 74 and gradually extends upwardly from engagement with the output roller 74 to the machine 10.

Figure 6:
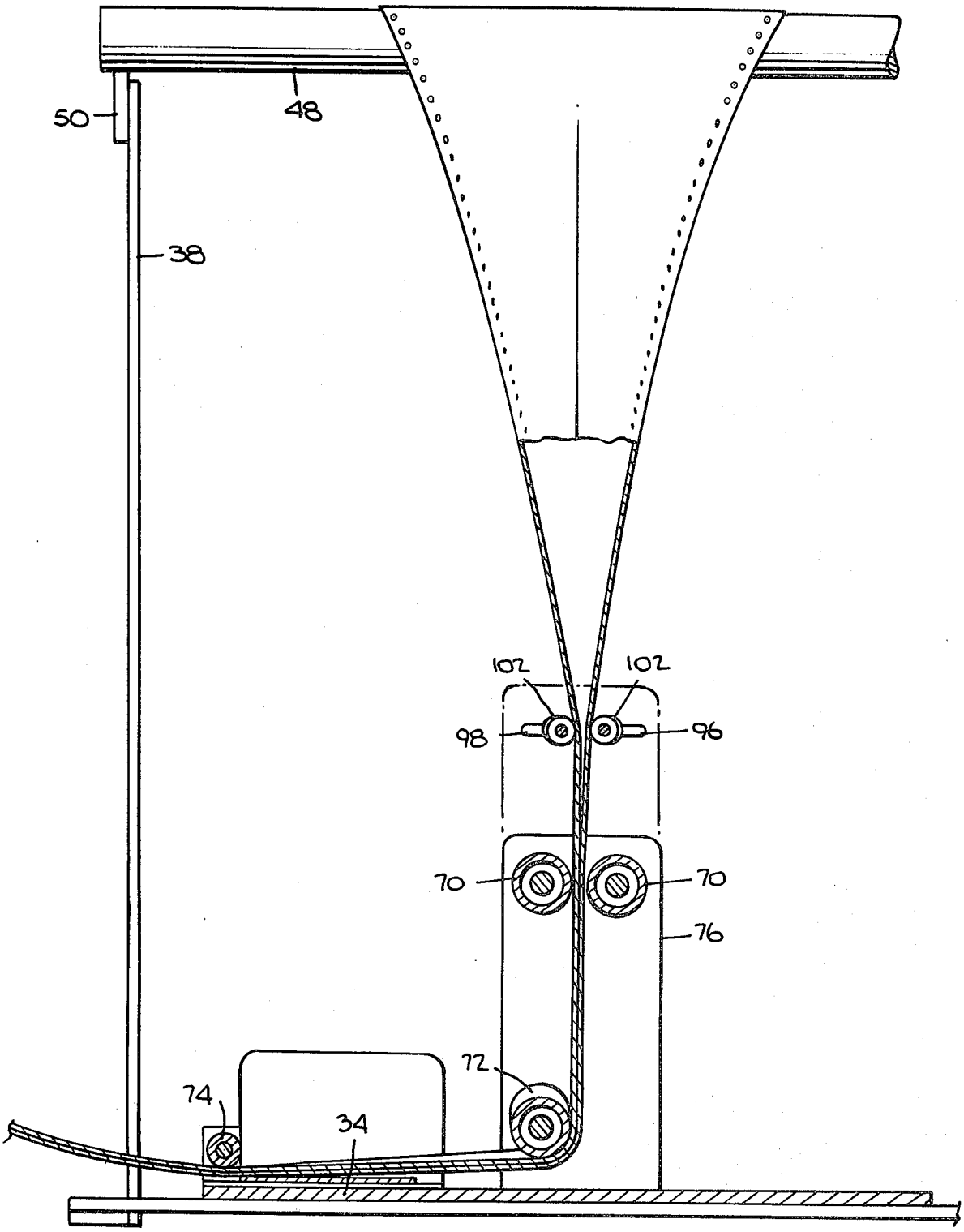
FIG. 6 is a sectional view taken substantially along the line 6—6 of FIG. 3.

To facilitate guiding the folded web 12 out of the apparatus 18 (FIG. 2), the apparatus 18 includes an upright guide plate 85. The plate 85 is conventionally movably attached to the frame 30, as by magnetic means such as a magnet 86 (FIG. 6) attached to the plate 85 for fastening the same to the frame's base plate 34. The plate 85 (FIG. 2) longitudinally extends between the lower roller 72 and output roller 74 and acts as a wall against which the fold edge 88 of the folded web 12 may be urged by the machine 10 for guidance to the machine 10.

Figure 3:
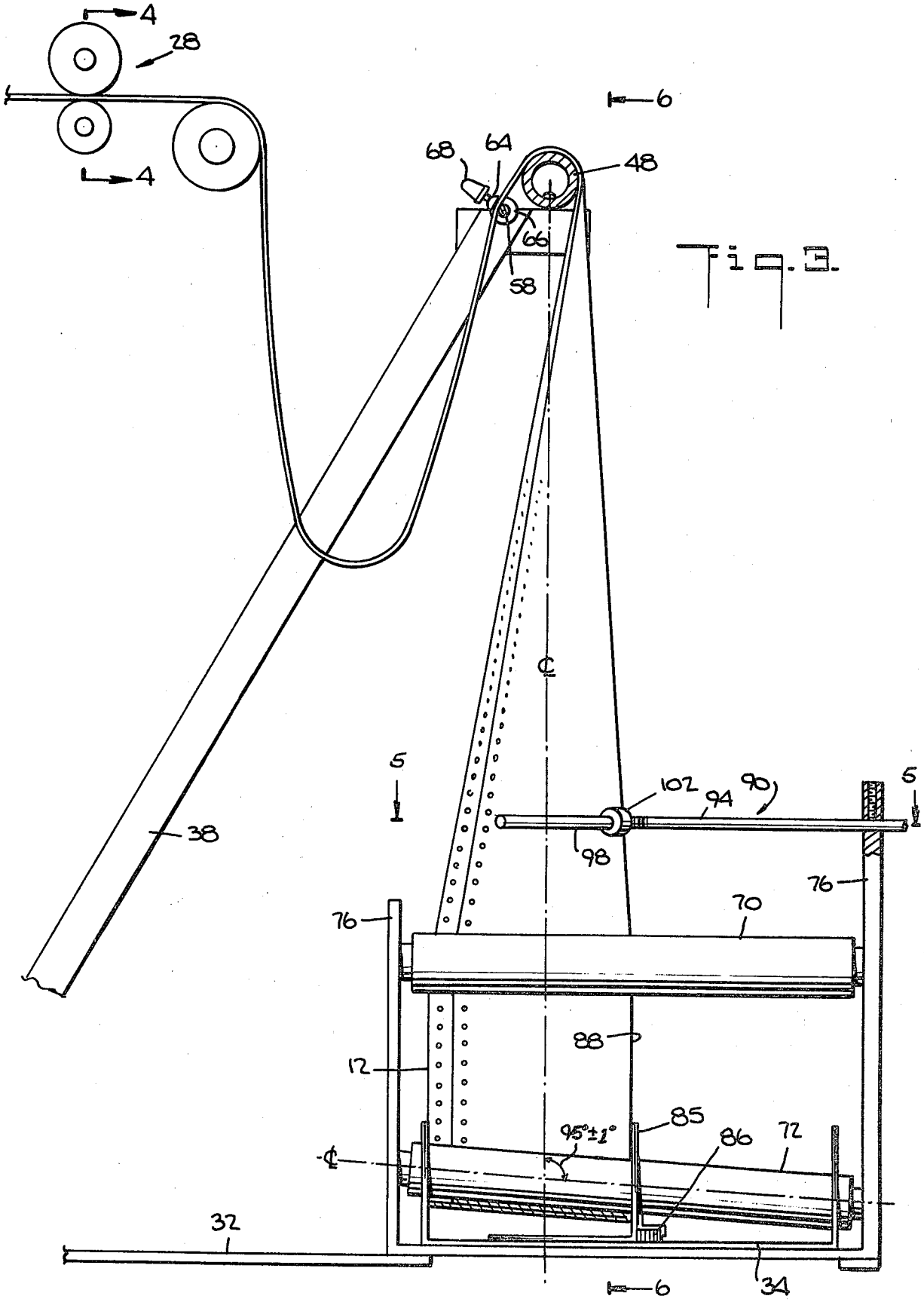
FIG. 3 is a fragmentary side view of the web folding apparatus of FIG. 2.
Figure 4:
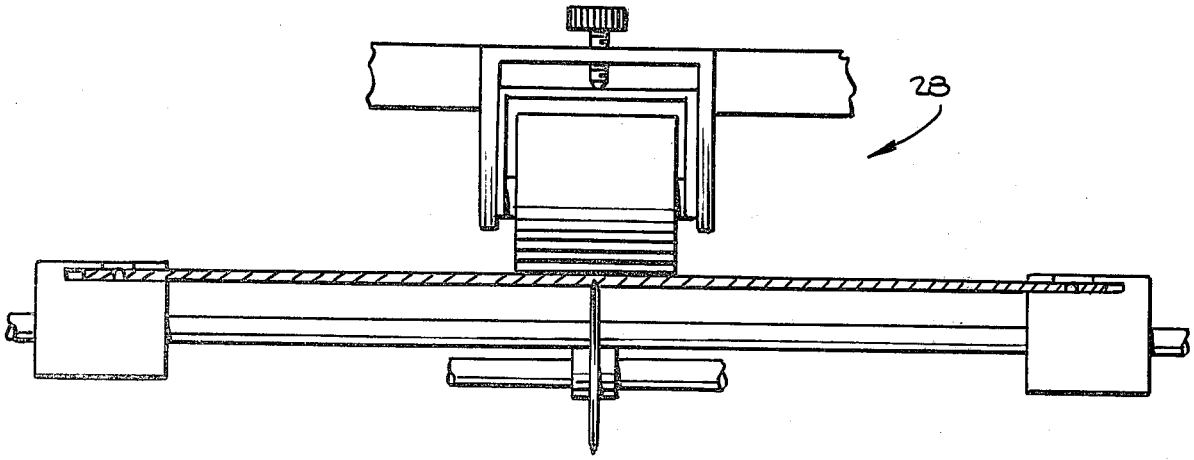
FIG. 4 is an enlarged, fragmentary, sectional view taken substantially along the line 4—4 of FIG. 3 showing conventional web scoring means.
Figure 5:
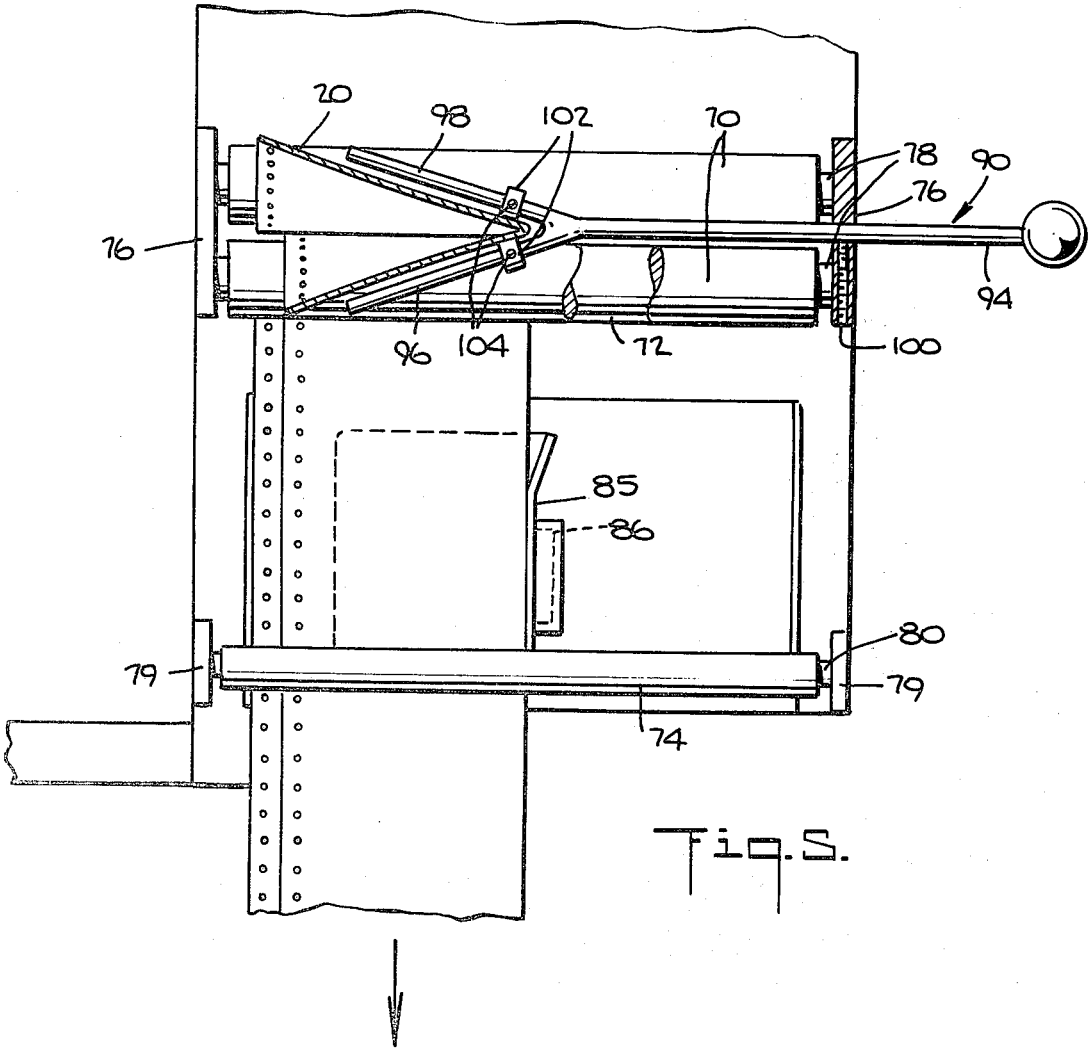
FIG. 5 is an enlarged, fragmentary, sectional view taken substantially along the line 5—5 of FIG. 3, showing the web guide means according to the invention.

For guiding the unfolded web 20 into its folded condition, the apparatus 18 additionally included pre-creasing means, including a substantially horizontally extending Y-shaped arm 90, which has three legs 94, 96, and 98; leg 94 of which is conventionally fixedly attached to the frame 30, as by means of set screws 100 (FIGS. 3, 5). The leg 94 and thus the arm 90, is preferably attached to the bracket 76 which is most distantly located from the scoring device 28 (FIG. 2) or fan-folded stack 42 (FIG. 1), as the case may be so, that the leg 94 (FIG. 2) is longitudinally aligned with the web's fold line 22. The other two legs 96, 98 of the arm 90 extend towards the partially folded web 20 for guidance of the web panels disposed on opposite sides of the fold line 22. The pre-creasing means additionally includes a pair of spaced apart drag elements 102, which are preferably collars that are adjustably fixedly attached to the legs 96 and 98, as by means of set screws 104, on a one-for-one basis. The drag elements 102 are preferably adjusted for selectively positioning the same along their respectively associated legs 96 and 98 for engaging the partially folded web 20, approximately one-half to three-quarters of an inch from the weakened fold line 22 of the web, to facilitate pre-creasing the web 20 along its weakened fold line 22. To still further facilitate guidance of the folded web 12, the collars 66 (FIGS. 2 and 3) which adjustably fixedly attach the finger members to the guide bar 58 are slidably as well as rotatably mounted on the guide bar 58, as a result of which the collars 66 and thus the finger members 64 are connected to the frame 30 for movement toward and away from each other and, therefore, into and out of engagement, on a one-for-one basis, with the opposed edges of the unfolded web 20. With this arrangement, the unfolded web 20 may be appropriately located lengthwise of the drag member 48 to facilitate properly locating the fold line 22 of the partially folded web 12 into alignment with the supporting leg 94 of the drag element 90, as a consequence of which the collars 66 and finger members 64 cooperate with the drag element 90 for urging the fold edge 88 of the folded web 12 into proper engagement with the collars 102.

In accordance with the objects of the invention there has been described a web folding apparatus for use in combination with a machine for feeding a web.

Inasmuch as certain changes may be made in the above described invention without departing form the spirit and scope of the same, it is intended that all matter contained in the above description or shown in the accompanying drawings shall be interpreted in an illustrative rather than the limiting sense. And, it is intended that the following claims be interpreted to cover all the generic and specific features of the invention herein described.

What is claimed is:

1. For use in combination with a machine for feeding a web of paper in a downstream path of travel, apparatus for folding an unfolded web of paper along a longitudinally-extending weakened fold line thereof, said apparatus comprising:

(a) a frame;

(b) web drag means including an elongated drag member fixedly attached to the frame and horizontally extending across the path of travel of an unfolded web for frictional engagement thereby;

(c) an elongate lower roller rotatably attached to the frame below the level of the drag member and extending transverse to the drag member such that the axis of the lower roller extends downwardly and at an angle of 95° plus or minus one degree with respect to a vertical plane extending through the drag member such that an unfolded web may extend downwardly in the path of travel from said drag member to and into engagement with said lower roller and be guided thereby so as to be gradually folded between said drag member and lower roller;

(d) an output roller, said output roller rotatably attached to the frame below the level of the drag member and extending transverse to said drag member such that said folded web may extend in the path of travel from beneath said lower roller to said output roller and into engagement therewith and such that said folded web may extend upwardly in the path of travel from beneath said output roller to said machine; and (e) web guide means including a pair of drag elements spaced apart from each other and connected to the frame and extending into engagement with the web between the drag member and lower roller such that said elements respectively engage the gradually folding web on opposite sides of the fold line for pre-creasing the web along the fold line as said machine feeds the web in said downstream path of travel.

2. The apparatus according to claim 1, wherein said web guide means includes an upright guide plate movably connected to the frame so as to extend between the lower and output rollers for guiding the folded web to the machine.

3. The apparatus according to claim 1, wherein said web drag means includes means cooperative with said drag member for adjusting the extent of frictional engagement of the unfolded web with said drag member.

4. The apparatus according to claim 3, wherein said means for adjusting the extent of web engagement includes a pair of finger members which are spaced apart from each other and adjustably fixedly attached to said frame for positioning in engagement with one of the surfaces of the unfolded web.

5. The apparatus according to claim 4, wherein said means for adjusting the extent of web engagement includes an elongated guide bar fixedly attached to said frame so as to longitudinally extend parallel to the drag member and upstream thereof in said path of travel, and said finger members adjustably fixedly attached to said guide bar for rotation into and out of engagement with said one of the surfaces of said unfolded web.

6. The apparatus according to claim 1, wherein said web drag means includes a pair of collars which are spaced apart from each other and adjustably fixedly attached to the frame for positioning the collars in engagement with the opposed edges of said unfolded web.

7. The apparatus according to claim 1, wherein said web guide means includes an arm adjustably fixedly attached to said frame, and said drag elements attached to said arm for connection to said frame.

8. The apparatus according to claim 1, wherein said web drag means includes an elongated guide bar fixedly attached to said frame so as to extend parallel to said drag member, a pair of collars spaced apart from each other and adjustably fixedly attached to said guide bar, a pair of finger members extending from said collars on a one-for-one basis, and said collars rotatable for adjusting the extent the respective finger members urge said unfolded web into frictional engagement with said drag member.

* * * * *